United States Patent [19]

Lehle

[11] 3,935,693

[45] Feb. 3, 1976

[54] DEVICE FOR SMOOTH PRESSING SHRINK FOIL WRAPPINGS

[75] Inventor: Robert Lehle, Ehningen, Germany

[73] Assignee: Karl Leibfried GmbH, Herrenberg, Germany

[22] Filed: Aug. 6, 1974

[21] Appl. No.: 495,117

[30] Foreign Application Priority Data

Aug. 9, 1973 Germany ..... 2340339

[52] U.S. Cl. ..... 53/184 R; 53/387

[51] Int. Cl.² ..... B65B 53/02

[58] Field of Search ..... 53/387, 388, 184

[56] References Cited

UNITED STATES PATENTS

| | | | |
|---|---|---|---|
| 1,543,843 | 6/1925 | Gwinn | 53/388 |
| 3,208,195 | 9/1965 | Rodman | 53/387 |
| 3,340,670 | 9/1967 | Anderson et al. | 53/184 S X |

FOREIGN PATENTS OR APPLICATIONS

| | | | |
|---|---|---|---|
| 1,929,690 | 11/1969 | Germany | 53/184 SF |

*Primary Examiner*—Travis S. McGehee
*Assistant Examiner*—Horace M. Culver
*Attorney, Agent, or Firm*—Walter Becker

[57] ABSTRACT

A packaging device in which articles enclosed in shrinkable wrapping are conveyed through a shrink tunnel. At the exit end of the tunnel roller pairs are moveably supported for lateral movement into engagement with the sides of the articles. Each roller pair comprises a driver roller nearest the tunnel and a nondriver roller remote from the tunnel. The rollers of each pair are floatingly supported so both engage the respective side of an article. Photoelectric sensing means is provided to be actuated by the articles emerging from the tunnel and controlling the movement of the roller pairs toward and away from the sides of the articles.

8 Claims, 3 Drawing Figures

DEVICE FOR SMOOTH PRESSING SHRINK FOIL WRAPPINGS

The present invention relates to a device for smooth pressing shrinkable foil packages. The device is equipped with two pressing rollers arranged at the outlet of the shrink tunnel. These by means of a post-guiding device are adapted to have the distance between the pressing rollers varied. The press rollers are furthermore adapted to be pressed against the two sides of the articles wrapped in shrinkable foil and by means of a conveying device of the shrink tunnel being conveyed between said pressing rollers.

A device of the above type is known and disclosed, for instance, in German Offenlegungsschrift No. 1,929,690. This device is intended particularly for smoothing out unevenness occurring in the shrink foil wrapping and originating with the lateral closure of the shrink foil wrapping. Due to the pressure of the pressing rollers upon the still warm foil material, a particularly firm lateral closure of the shrink foil wrapping is brought about when the lateral projecting portions of a shrink foil band under the effect of the heat in the shrink tunnel are folded in pairs one above the other and are connected to each other. Similarly, shrink foil ends project laterally from the shrink foil wrapping. The rim strips remain outside the fusion seam and originate with a lateral closure fusing or welding. These strips are permanently rolled against the lateral surfaces of the closed shrink foil wrapping. The post-guiding device are provided for the pressing rollers. By means of the device for smooth pressing shrink foil wrappings and thus also by means of the shrink tunnel, there is made possible to convey articles enclosed in a shrink foil, though while said articles may have different widths.

With the heretofore known device for smooth pressing shrink foil wrappings, it is possible by means of the post-guiding device to press two pairs of pressing rollers against the two sides of the articles wrapped in shrink foil. The two pressing rollers of each pair of pressing rollers are rotatably journaled on the two ends of one pivotable lever. Each thereof at its central portion is rotatably journaled on the post-guiding device and by means of a spring and an abutment is adapted to be returned to its basic or starting position. In this way it is possible, to start the operation of the smooth pressing at the preceding end face of a shrink foil wrapping while being able even around embossed edges to smooth or iron around the front and rear ends of the lateral surfaces of a shrink foil wrapping. For purposes of forming the post-guiding device, with the above mentioned heretofore known device particularly at the exit of the shrink tunnel, for purposes of smooth pressing shrink foil wrappings, there are provided two pivotable arms which are rotatably journaled approximately at the level of the ceiling of the shrink tunnel. Accordingly can be pivoted relative to each other. These pivotable arms are tensioned relative to each other by means of a tension spring.

The pressing force imparted upon the pressing rollers is dependent on the respective width of the articles wrapped in shrink foil so that with decreasing width of the shrink foil wrappings which are moved by the conveying device of the shrink tunnel between the pressing rollers, especially with the smoothing out of creases and folds, always poor results are obtained. Furthermore, with the heretofore known devices, there exists the danger that the shrink foil wrappings will get stuck between the pressing rollers and will be damaged by the conveying device of the shrink tunnel passing along the bottom side of said wrappings. This is true when the pressing force conveyed by the pressing rollers upon the foil material will increase in view of a better work result, and above all when the articles wrapped in shrink foil have a relatively low weight.

It is, therefore, an object of the present invention to improve the device of the above mentioned general type to permit the pressing rollers to be adapted to different widths of the articles wrapped in shrink foil and to make possible the adoption of higher pressures of the pressing rollers while eliminating for the shrink foil wrappings the danger of getting stuck.

These and other objects and advantages of the invention will appear more clearly from the following specification, in connection with the accompanying drawings, in which.

The device according to the present invention is characterized primarily in that at least one of the two pressing rollers is equipped with a drive which imparts upon the roller mantle of the respective pressing roller a conveying speed which corresponds to the conveying speed of the shrink tunnel.

According to a particularly advantageous further development of the invention, the conveying device of the shrink tunnel is provided with a transporting chain while the driven pressing roller is connected through a flexible shaft to a chain sprocket which is in mesh with the transporting chain and which has a pitch diameter corresponding to the outer diameter of the pressing roller connected thereto. In this way, the driven pressing roller will, even with a larger load on its drive will maintain a safe synchronism with the conveying device of the shrink tunnel so that the additional costs for adding the press roller drive will be kept particularly low.

For forming the post-guiding device there are provided two pivotable arms. There arms are rotatably journaled at the exit of the shrink tunnel approximately at the level of the ceiling of the shrink tunnel. These arms are pivotable relative to each other. In between the two pivotable arms there is provided an actuating member common to both pivotable arms. Further development of the invention is of particular advantage. This development consists in that the two pivotable arms by way of a guiding rod are pivotally connected to the piston rod of a compressed air cylinder piston system which extends in the direction of the shrink tunnel in which the articles to be wrapped are passed therethrough. By means of such actuating member for both pivotable arms, the pressing force imparted upon the pressing rollers is dependent considerably less upon the respective width of the articles wrapped in shrink foil than is the case with the heretofore known device. With the known device referred to, the two pivotable arms are tensioned relative to each other by a tension spring. At the same time, the adaptability of the pressing rollers to different widths of the articles wrapped in shrink foil is considerably enhanced. Moreover, higher pressing roller pressures may be utilized without any material increase in the space required by the device and the costs of making same.

Figure 1:
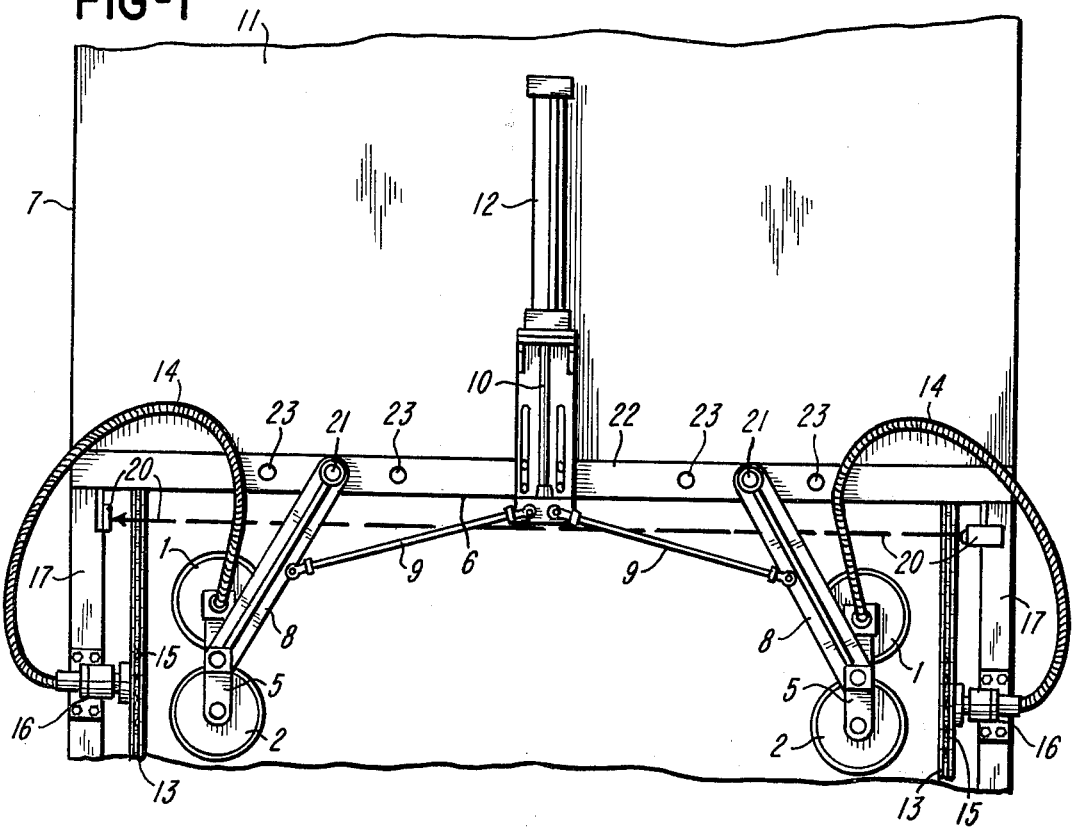
FIG. 1 is a top view of the device according to the invention for smooth pressing shrink foil wrappings, said device being arranged in the exit of a shrink tunnel.

Referring now to the drawings in detail, the device illustrated therein for smooth pressing shrink foil wrappings comprises two pairs of pressing rollers 1, 2 which are adapted by means of a post-guiding device to be pressed against the two sides of the articles wrapped in the shrink foil. The two pressing rollers 1 and 2 of each pair of rollers are rotatably journaled at the two ends respectively of a pivotable lever 5. The lever 5 is rotatably mounted at its central portion on the post-guiding device. By means of a spring 3 and an abutment 4, the lever 5 is adapted to be returned to its starting or base position. In this way, care will be taken that the two pressing rollers 1 and 2 always occupy the same sequence. In addition thereto, the base position according to FIG. 1, as brought about by the spring 3 and the abutment 4 is preferably so selected that the two pressing rollers 1 which are closer to the exit 6 of the shrink tunnel 7, and the two other pressing rollers 2 in their position in which the two pivotal arms 8 pertaining to the post-guiding device are pivoted farthest from each other, will have the same mutual distance.

The two pivot arms 8 are rotatably journaled at the exit 6 of the shrink tunnel 7 and through one guiding rod 9 each is pivotally connected to the piston rod 10 of the compressed air cylinder 12. The latter extends on the cover 11 of the shrink tunnel 7 in the center in the direction in which the article passes through the shrink tunnel 7. When pivoting inwardly the said two pivot arms 8, first the distance between the two pressing rollers 2 decreases to a greater extent than the distance between the two pressing rollers 1. With the advance of the shrink foil wrapping toward the next following pressing rollers 2, the shrink foil wrapping was initially grasped only by the pressing rollers 1. The pressing rollers 2 are then somewhat pressed apart. While overcoming the force of the springs 3 so that when the side surfaces which are parallel to each other are rolled over, the distance between the pressing rollers will again be the same as the distance between the pressing rollers 1. Thus by means of the pressing rollers, a fusing or ironing around the roundings or edges at the front end of the lateral surfaces of a shrink foil wrapping is effected. At the rear end of the lateral surfaces of the shrink foil wrapping, the pressing rollers 1 take over this task because here the distance between the pressing rollers 1 with regard to the distance between the pressing rollers 2 is decreased by the unilateral relief of pressing roller pairs 1, 2 under the influence of the compressed air cylinder 12.

Figure 2:
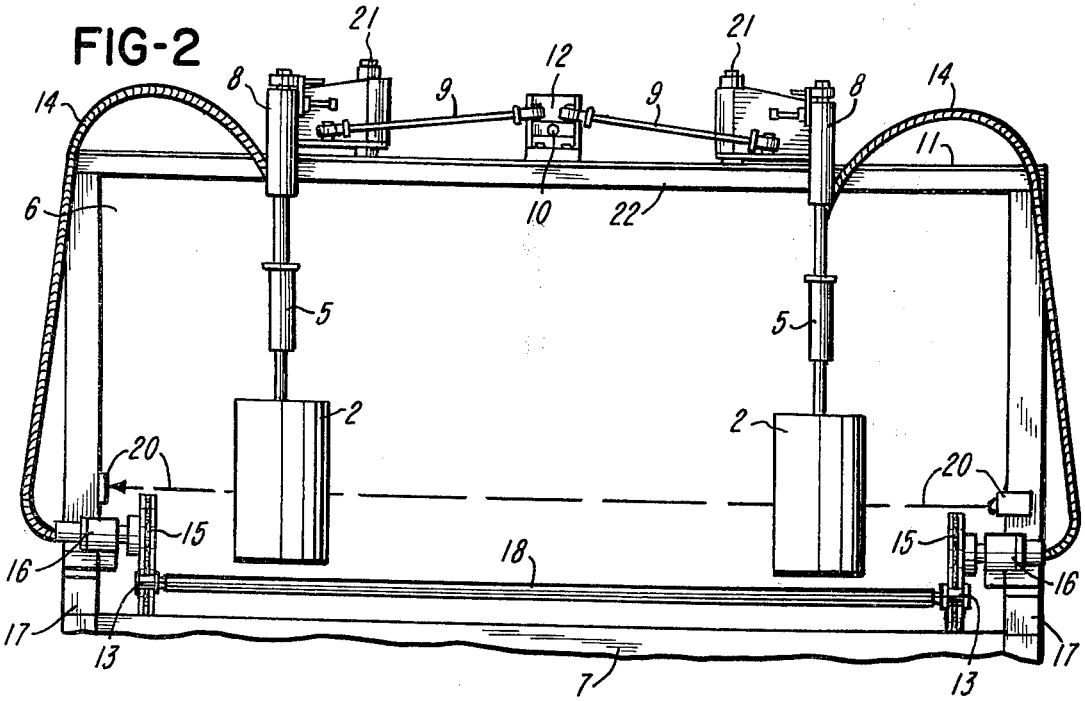
FIG. 2 shows a front view of the device as it appears when looking into the exit of the shrink tunnel.
Figure 3:
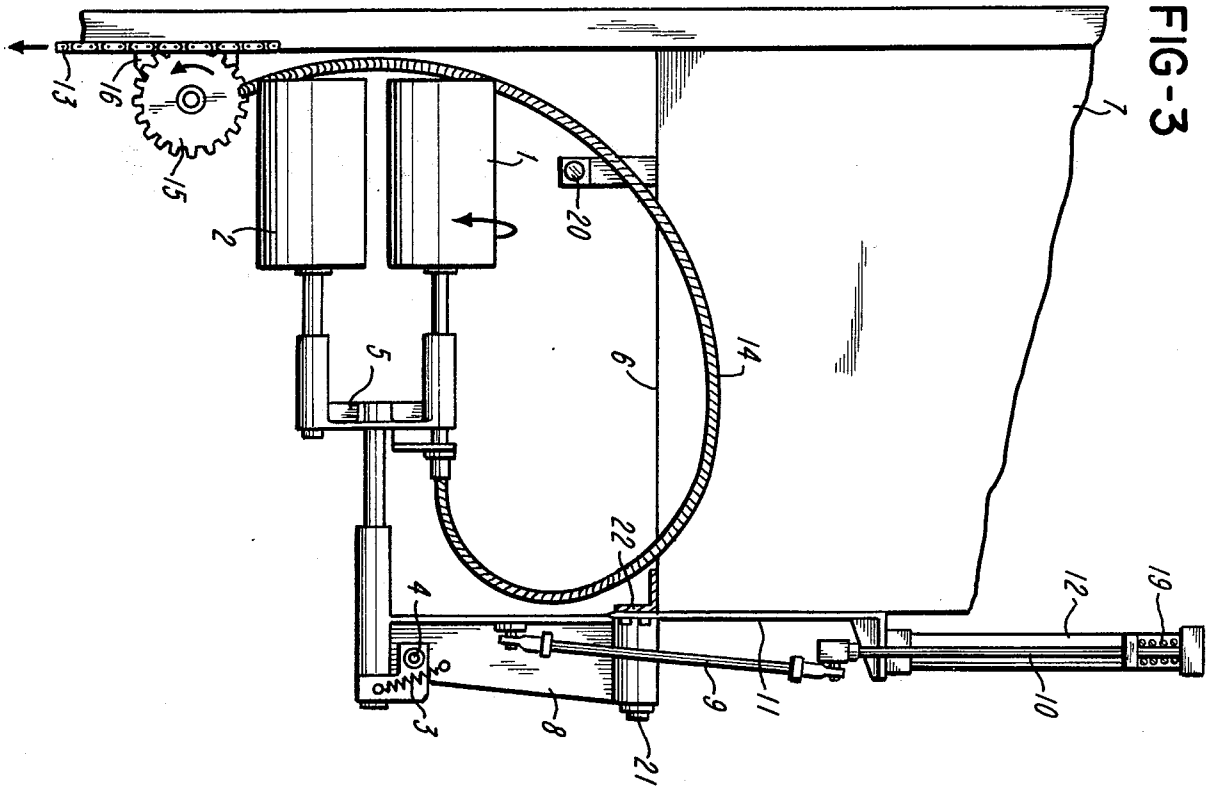
FIG. 3 is a fragmentary side view of the device according to the invention.

Conveying device of the shrink tunnel 7 comprises on each of its two sides a transport or conveyor chain 13. Furthermore each of the two pressing rollers facing each other by way of a flexible shaft 14 and a sprocket wheel 18 is adopted to be driven by the respective adjacent transport or conveyor chain 13. Thus it will be appreciated that in the device for smooth pressing shrink foil wrappings, non-symmetric forces distribution are avoided with particularly few parts and at particularly low expense. The flexible shaft 14 is connected from above to the pertaining pressing roller 1. Thus the rollers 1 and 2 may end just above the conveying device of the shrink tunnel 7. The other end of the flexible shaft 14 was moved from the outside of the device to the respective sprocket wheel 15 mounted from above to the conveying chain 13. In this way, due to the two flexible shafts 14, the least interference is encountered in the entire region of movement of the connected pressing rollers 1. Each of the two sprocket wheels 15 has a holding member 16 which is connected in the vicinity of the pertaining pressing roller 1 to a lateral frame section 17 of the shrink tunnel 7. The two transport chains 13 are connected to each other by means of a plurality of transporting pairs 18 which are parallel to each other. For the sake of clarity, a conveying bar 18 is shown only in FIG. 2. At this point, it may be mentioned that the conveying device 13, 18 of the shrink tunnel 7 extends to a major extent beyond the exit 6 of the covered-up tunnel section. The shrinking process which is caused in the foil material by the heating up in the covered-up tunnel section gradually decreases outside said region.

For reasons of economy, the compressed air cylinder 12 is a single acting compressed air cylinder equipped with a return spring 19. This cylinder 12 is at the level of the two pivotable arms 8 which are symmetrical thereto. The pairs of pressing rollers 1, 2 supported by the pivot arm 8 will thus in the nonloaded starting position of the compressed air cylinder 12 have their greatest distance from each other. The return spring 19 thus does not serve for creating a pressing roller pressure and therefore may be relatively weak.

When the compressed air cylinder 12 receives compressed air, the piston rod 10 is moved in the direction toward the inlet of the shrink tunnel 7 (not shown in the drawing). Each of the two guiding bars 9 is subjected to pulling stresses.

When viewing in the direction in which the article passes through the shrink tunnel 7, ahead of the pressing rollers 1 there is provided a light barrier 20 for selectively controlling the supply of compressed air to the compressed air cylinder 12. This controlling occurs by means of articles wrapped in shrink foil. Thus the pressing rollers 1 and 2 when interrupting the light barrier 20 will automatically pivot inwards. The light barrier 20 when free will result therein that the rollers automatically return to their lateral starting position. In this way, the play of adaptation of the pressing rollers 1 and 2 to different widths of the articles wrapped in shrink foil is further increased. So that with relatively short pivot arms 8 it it possible also to grasp particularly narrow and particularly wide shrink foil wrappings, three receiving bores 23 offset with regard to each other are provided for the bearing bolts 21 of each pivotable arm 8 in the transverse beam 22 of tunnel 7 which overlaps the exit 6. This arrangement also includes a guiding bar 9 of different length.

Once a pair of pressing rollers has been mounted on each pivotable arm 8, a differentiation has been created. Thus within each pair of pressing rollers, viewed in the direction in which the article passes through the tunnel 7, the pressing roller 1 equipped with a drive 14, 15 is followed by a pressing roller 2 without drive. In this way, the provision of more than two drives 14, 15 is avoided. At the same time with the selected association of the drives 14, 15 with the two pressing rollers 1 first wrapped by the shrink foil wrappings, the danger is eliminated that the articles wrapped in shrink foil and conveyed on the transporting bars 18 through the shrink tunnel 7 at a lower weight of the article still will get stuck. The pressing rollers 1 already exert pressure upon the sides of the shrink foil wrapping, and the pressing rollers 2 have been pivoted closer to each other until just engaging the shrink foil wrapping.

The device for smooth pressing shrink foil wrappings according to the invention is also characterized in the following manner. The pressing rollers 1 and 2 and slightly by way of the rods 18 and by means of the roller mantle thereof engage only a fraction of the height of the passage in the shrink tunnel 7. Due to this step, the force exerted by the pressure cylinder 12 is concentrated onto a smaller pressure surface of the press rollers 1 and 2. Thus the shrink tunnel 7 is particularly suitable for a lateral closure of the shrink foil wrapping as effected in the shrink tunnel 7. With such closure, the lateral protruding portions of the lower foil are relatively small whereas the lateral protrusions of the upper foil extend nearly to the spread-out lower foil. The lateral protrusions of the lower foil due to their lower weight and due to the heat effect of the shrink tunnel 7 will stand up by themselves and will combine with the lateral protrusions of the upper foil. The pressing rollers 1 and 2 which are arranged rather far down, impart upon this connection a considerably higher strength. In this connection, it may be mentioned that the pairs of pressing rollers 1, 2 arranged at the exit 6 of the shrink tunnel 7 may also be located entirely or partially in the covered up portion of the shrink tunnel 7. However, in order to keep in mind better work results with the heating up of the pressing rollers 1 and 2, within appropriate limits, the pressing rollers 1 and 2 are preferably outside the covered portion of the shrink tunnel 7.

It is, of course, to be understood that the present invention is, by no means, limited to the specific showing in the drawings, but also comprises any modifications within the scope of the appended claims.

What is claimed is:

1. In a device in which articles are enclosed in shrink foil wrapping, the device including a tunnel and conveyor chain means moveable along the tunnel for conveying articles through the tunnel from the entrance end thereof to the exit end, the improvement comprising; pressing roller means at the exit end of the tunnel for engaging the sides of wrapped articles emerging from the tunnel, said roller means being rotatable on axes perpendicular to the plane of movement of the articles, support means supporting said roller means for movement parallel to said plane, drive means connected to at least one roller of said roller means and imparting a peripheral velocity thereto on the side facing said articles substantially conforming to the velocity imparted to said articles by said conveyor chains, said drive means including a sprocket having a pitch diameter equal to the diameter of said driven roller and meshing with said chain, and a flexible drive shaft connecting the sprocket to the driven roller.

2. In a device in which articles are enclosed in shrink foil wrapping, the device including a tunnel and conveyor chain means moveable along the tunnel for conveying articles through the tunnel from the entrance end thereof to the exit end, the improvement comprising; pressing roller means at the exit end of the tunnel for engaging the sides of wrapped articles emerging from the tunnel, said roller means being rotatable on axes perpendicular to the plane of movement of the articles, support means supporting said roller means for movement parallel to said plane, drive means connected to at least one roller of said roller means and imparting a peripheral velocity thereto on the side facing said articles substantially conforming to the velocity imparted to said articles by said conveyor chains, said chain means comprising a chain along each side of the tunnel, said roller means comprising a roller on each side of the path of articles through said tunnel, a sprocket having a pitch diameter equal to the diameter of a said roller and meshing with each chain, and a flexible shaft connecting each sprocket with the roller on the same side of the tunnel.

3. A device according to claim 1 in which said roller means comprises a pair of rollers on each side of the article path through the tunnel, each pair of rollers comprising a first roller near the tunnel and a second roller remote from the tunnel, a lever for each pair of rollers having the rollers journaled therein near the lever ends, an arm pivotally mounted on the tunnel and extending therefrom to each lever and pivoted to the respective lever in about the middle thereof, spring means biasing each lever in one direction on the respective arm and abutment means bolting each lever in a predetermined rotated position on the respective arm, each said first roller having drive means connected thereto to drive the side of each first roller which faces the article path at the same velocity as the article.

4. In a device in which articles are enclosed in shrink foil wrapping, the device including a tunnel and conveyor chain means moveable along the tunnel for conveying articles through the tunnel from the entrance end thereof to the exit end, the improvement comprising; pressing roller means at the exit end of the tunnel for engaging the sides of wrapped articles amerging from the tunnel, said roller means being rotatable on axes perpendicular to the plane of movement of the articles, support means supporting said roller means for movement parallel to said plane, drive means connected to at least one roller of said roller means and imparting a peripheral velocity thereto on the side facing said articles substantially conforming to the velocity imparted to said articles by said conveyor chains, said roller means comprising a pair of rollers on each side of the article path through the tunnel, each pair of rollers comprising a first roller near the tunnel and a second roller remote from the tunnel, a lever for each pair of rollers having the rollers journaled therein near the lever ends, an arm pivotally mounted on the tunnel and extending therefrom to each lever and pivoted to the respective lever in about the middle thereof, spring means biasing each lever in one direction on the respective arm and abutment means bolting each lever in a predetermined rotated position on the respective arm, each said first roller having drive means connected thereto to drive the side of each first roller which faces the article path at the same velocity as the article, an actuating device common to said arms operable for moving said arms toward each other in unison to cause said rollers to engage the sides of articles moving out of the tunnel, said actuating device comprising a fluid cylinder having a piston moveable therein, and rods connecting said piston to said arms.

5. A device according to claim 4 in which said fluid cylinder and piston are single acting and are operable by compressed air to move the arms toward each other, and a return spring associated with said cylinder and piston for moving the arms away from each other upon the exhausting of said cylinder.

6. A device according to claim 5 which includes photoelectrically operable means sensitive to the movement of articles out the exit end of the tunnel for controlling the supply of compressed air to and the exhausting of air from the said cylinder.

7. A device according to claim 1 in which said support means are above said roller means and the lower ends of said roller means are disposed above the level of the bottom of articles emerging from the tunnel whereby the roller means engage a portion only of the height of the articles.

8. A device according to claim 3 which includes means for adjusting the points of pivotal connection of the tunnel ends of said arms in the lateral direction to accommodate the roller means to articles of different width.

* * * * *